US007018259B2

(12) United States Patent
Ryu et al.

(10) Patent No.: US 7,018,259 B2
(45) Date of Patent: Mar. 28, 2006

(54) SPACER OF A FLAT PANEL DISPLAY AND PREPARATION METHOD OF THE SAME

(75) Inventors: Kyung-Sun Ryu, Seongnam (KR); Hyun-Ki Park, Seoul (KR)

(73) Assignee: Samsung SDI, Co., Ltd., Suwon-si (KR)

( * ) Notice: Subject to any disclaimer, the term of this patent is extended or adjusted under 35 U.S.C. 154(b) by 184 days.

(21) Appl. No.: 10/357,441

(22) Filed: Feb. 4, 2003

(65) Prior Publication Data

US 2003/0160932 A1 Aug. 28, 2003

(30) Foreign Application Priority Data

Feb. 27, 2002 (KR) ..... 2002-10584

(51) Int. Cl.
*H01J 9/00* (2006.01)

(52) U.S. Cl. ..... 445/24

(58) Field of Classification Search ..... 445/24, 445/25; 430/311–321; 216/41
See application file for complete search history.

(56) References Cited

U.S. PATENT DOCUMENTS 3,837,724 A * 9/1974 Haberland et al. ..... 445/25
5,163,220 A * 11/1992 Zeto et al. ..... 430/313
5,840,201 A * 11/1998 Elledge ..... 216/24
5,894,193 A * 4/1999 Amrine et al. ..... 313/495
6,184,621 B1 * 2/2001 Horiuchi et al. ..... 313/586
6,511,793 B1 * 1/2003 Cho et al. ..... 430/323

OTHER PUBLICATIONS

"Study of High-Pressure Glow Discharges Generated by Micro-Structured Electrode (MSE) Arrays", Maria Cristina Penache, 2002, cover page, title page and p. 11.*

* cited by examiner

*Primary Examiner*—Joseph Williams
(74) *Attorney, Agent, or Firm*—Robert E. Bushnell, Esq.

(57) ABSTRACT

Disclosed is a spacer of a flat panel display (FPD) and a method for preparing the same. The method for preparing a spacer of the present invention includes: (a) exposing a photosensitive glass to a light; (b) heat-treating the exposed photosensitive glass to crystallize it; (c) etching the crystallized glass to prepare the spacer; and (d) heat-treating the spacer under a reductive gas atmosphere. The spacer can be easily prepared by the method according to the present invention, and it has improved conductivity on its surface. A flat panel display including the spacer prepared by the method of the present invention has enhanced conductivity. Therefore, the spacer prevents secondary electron emission, spacer charging, and deviation of electron beams.

19 Claims, 9 Drawing Sheets

SPACER OF A FLAT PANEL DISPLAY AND PREPARATION METHOD OF THE SAME

CLAIM OF PRIORITY

This application makes reference to, incorporates the same herein, and claims all benefits accruing under 35 U.S.C. §119 from an application for "*Spacer of Field Emission Display and Preparation Method of the Same*", filed in the Korean Patent Office on Feb. 27, 2002 and assigned Serial No. 2002-10584.

BACKGROUND OF THE INVENTION

1. Field of the Invention

The present invention relates to a spacer for a flat panel display (FPD) and a method of preparing the same, and in particular, to a spacer that is easy to prepare, of which the conductivity on the surface is improved enough to prevent secondary electron emission and spacer charging and to reduce electron beam deviation of the spacer, and a method of preparing the same.

2. Description of the Related Art

A flat panel display (FPD) includes a spacer that is positioned between two glass substrates and provides a gap between the substrates to maintain a gap of each cell of the FPD.

The spacer is preferably made of a photosensitive glass with good conductivity to obtain FPDs having excellent display qualities such as display image, brightness and color since the spacer prevents the emission of secondary electrons and spacer charging generated upon operation of FPDs.

To prepare a spacer with excellent conductivity, it is suggested to coat its face with a compound such as $CrO_2$, $TiO_2$ and $VO_2$. However, the spacer prepared by this coating method has a secondary electron coefficient of less than 4 and a sheet resistance of $10^9$ ohms-per-square (Ω/□) to $10^{14}$ Ω/□ rendering a problem in that conductivity is insufficient to prevent the emission of secondary electrons.

In addition, Saint-Gobain Co. has suggested a spacer that is produced from a semi-conductive material. However, this spacer has problems of that the conductivity of the spacer is insufficient to prevent the emission of secondary electrons and that the occurrence of spacer charging on the surface of the spacer is detected when it is observed by a scanning electron microscope (SEM). Further problems include that it is difficult to be prepared, and its manufacturing costs are high.

SUMMARY OF THE INVENTION

It is an object of the present invention to provide a method for preparing a spacer for a flat panel display (FPD), wherein the spacer is easily prepared and its conductivity is improved. Thus, the flat panel display having the spacer has excellent display qualities.

It is another object of the present invention to provide an improved spacer for a flat panel display that is produced by the aforementioned method.

It is another object of the present invention to provide a flat panel display (FPD) comprising the aforementioned spacer.

It is also an object of the present invention to provide a method of preparing a spacer which prevents the emission of secondary electrons, spacer charging, and deviation of electron beams.

The present invention further provides an FPD comprising the spacer.

The present invention further provides a field emission display (FED) comprising the spacer.

In order to accomplish the objects of the present invention, a method is provided for preparing a spacer for an FPD by exposing a photosensitive glass to a light; heat-treating the photosensitive glass to crystallize the photosensitive glass; etching the crystallized glass to prepare the spacer; and heat-treating the spacer under a reductive gas atmosphere.

It is preferred to mask a selected area of the photosensitive glass with a quartz mask. Preferably, a mercury lamp is used as a light source.

The step of heat-treating the photosensitive glass is preferably comprised of the steps of heat-treating at about 500° C. and then at about 600° C.

Preferably, the reductive gas may include hydrogen, ammonia, $H_2S$, and a mixed gas thereof, and more preferably hydrogen is used for the reductive gas. It is most preferable that the reductive gas is mixed with an inert gas such as nitrogen and argon in order to perform a safer process. The heat-treatment temperature in the step of heat-treating the spacer preferably ranges from 380° C. to 580° C.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

In the following detailed description, only the preferred embodiment of the invention has been shown and described, simply by way of illustration of the best mode contemplated by the inventors of carrying out the invention. As will be realized, the invention is capable of modification in various obvious respects, all without departing from the invention.

Accordingly, the drawings and description are to be regarded as illustrative in nature, and not restrictive.

Figure 1:
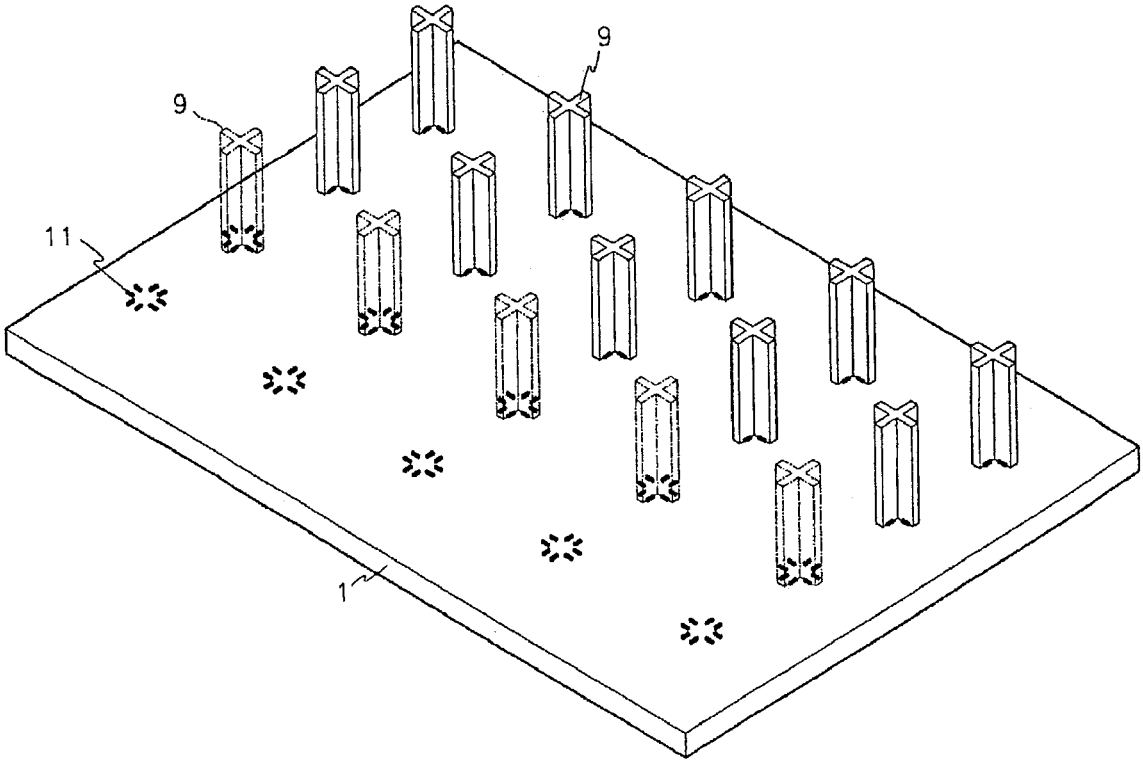
FIG. 1 is a cross-sectional view showing a spacer for a flat panel display that is fixed on a faceplate.

FIG. 1 shows a spacer 9 fixed by a spacer fixer 11 on a faceplate 1.

A method of preparing a spacer for a flat panel display includes the steps of (a) exposing a glass to a light; (b) heat-treating the photosensitive glass to crystallize it; (c) etching the crystallized glass to prepare a spacer; and (d) heat-treating the spacer under a reductive gas atmosphere.

First, a glass is exposed to a light (step (a)). The glass according to the present invention may preferably include any photosensitive glass that is commonly used in preparation of a spacer, and it is most preferably Forturan® (Mikroglas Co., Germany). Each composition of Forturan® and photosensitive glass is listed in Table 1.

TABLE 1

| | Forturan ® | Soda-lime glass | Borosilicate | A glass produced by Saint-Gobain Co. |
|---|---|---|---|---|
| $SiO_2$ | 75~85 wt % | 71~75 wt % | 70~80 wt % | 63 wt % |
| $LiO_2$ | 7~11 wt % | — | — | — |
| $K_2O$ | 3~6 wt % | — | — | 10 wt % |
| $Al_2O_3$ | 3~6 wt % | — | 2~7 wt % | 4.8 wt % |
| $Na_2O$ | 1~2 wt % | 12~16 wt % | — | 5 wt % |
| $Na_2O$ & $K_2O$ | — | — | 4~8 wt % | — |
| $ZnO_2$ | 0.2~0.4 wt % | — | — | — |
| $Sb_2O_3$ | 0.2~0.4 wt % | — | — | — |
| $Ag_2O$ | 0.05~0.15 wt % | — | — | — |
| $CeO_2O$ | 0.01~0.14 wt % | — | — | — |
| $B_2O_3$ | — | — | 7~13 wt % | — |
| $ZrO_2$ | — | — | — | 9 wt % |
| CaO | — | 10~15 wt % | — | 6 wt % |
| MgO | — | — | — | 1 wt % |

As represented in Table 1, Forturan® comprises $LiO_2$ and $Ag_2O$, and it may be preferably used for a surface glass of a spacer for an FPD with excellent conductivity.

Figure 2:
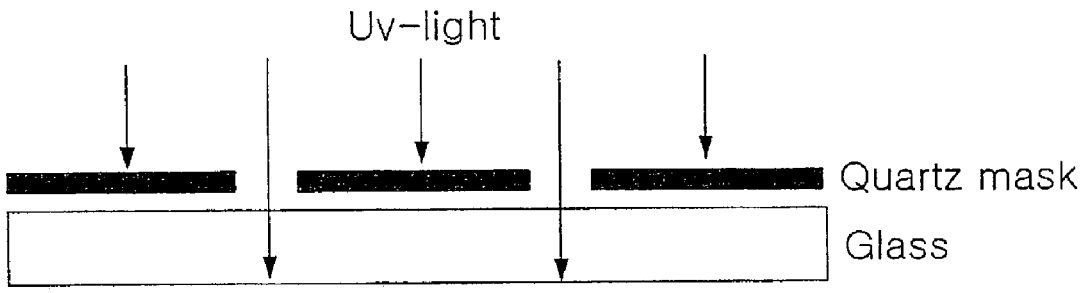
FIG. 2 is a cross-sectional view showing a method of exposing each photosensitive glass according to Examples 1 to 4 and Comparative Example 1 to ultraviolet rays.

The step of exposing a photosensitive glass to ultraviolet rays is illustrated in FIG. 2. As shown in FIG. 2, in order to provide a micro-structure, the photosensitive glass is preferably exposed to ultraviolet rays with use of a patterned quartz mask capable of blocking short waves such as ultraviolet rays since the photosensitive glass reacts to a short wavelength of around 310 nm.

Figure 3:
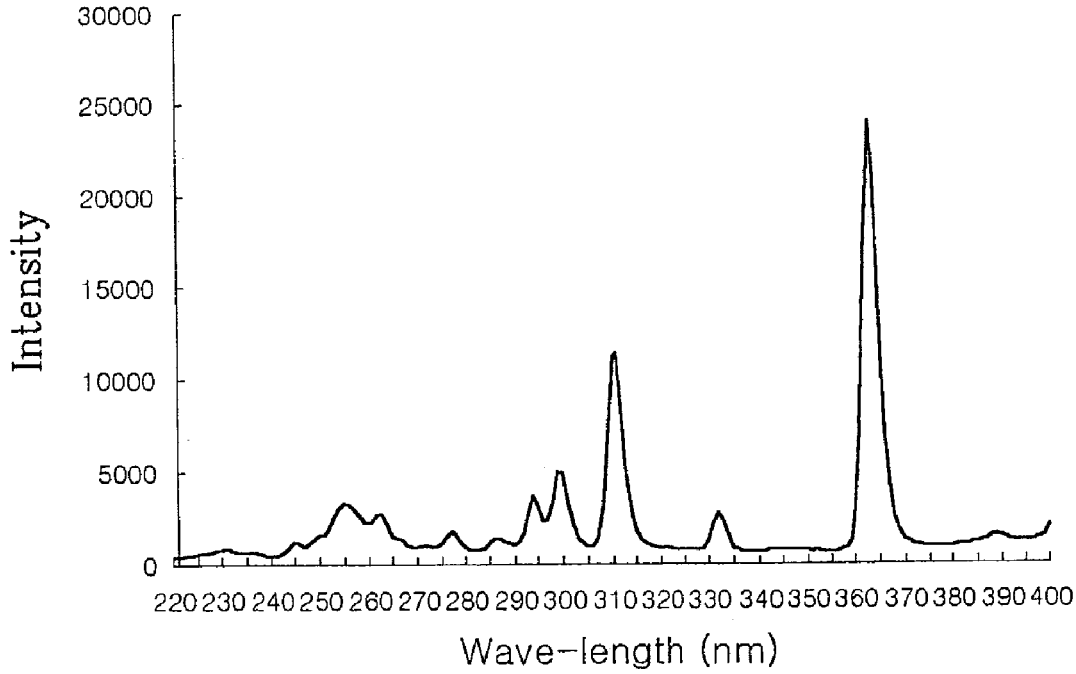
FIG. 3 is a graph illustrated a spectrum of a mercury lamp.

In FIG. 3, a lamp spectrum shows that it is preferable that a mercury lamp is used for the light source to expose the glass to a short wave of around 310 nm, since a mercury lamp has a high intensity at the wave-length of around 310 nm. In addition, as shown in FIG. 2, it is preferable that the glass is exposed perpendicularly to the ultraviolet rays in order to obtain high aspect ratio parts. The exposing time may be varied according to the experimental equipment. Preferably, the glass is exposed to a light with an energy of2 $J/cm^2$ regardless of the kind of experimental equipment.

The exposed amorphous glass is then heat-treated to crystallize the glass (step (b)). The heat-treatment is preferably performed in two steps. The first heat-treatment step is preferably performed at a temperature of around 500° C. In the first heat-treatment, an Ag-nucleation reaction occurs at the exposed area of the glass.

The next heat-treatment step is preferably performed at a temperature of around 600° C. During the second heat-treatment step, the amorphous glass is crystallized due to formation of $LiSiO_3$ around the Ag element.

By the two-step-heat treatment, the amorphous glass is transformed to a crystalline glass, and the crystalline glass may be preferably used for preparation of a spacer with high conductivity.

Therefore, the resultant crystalline glass is etched to provide a spacer (step (c)). An etching solution of the present invention preferably includes about 10 percent by weight of HF.

Both surfaces of the exposed glass are etched, and the crystallized glass has an etching rate of about 20 times faster than the non-crystallized glass. Therefore, the exposed glass may be selectively etched by the difference of etching rate between the crystallized glass and non-crystallized glass.

The spacer is heat-treated under a reductive gas atmosphere (step (d)). Preferably, the reductive gas may include hydrogen, ammonia, $H_2S$, and a mixed gas thereof, and more preferably hydrogen is used for the reductive gas. It is most preferable that the reductive gas is mixed with an inert gas such as nitrogen and argon in order to perform a safer process. When the spacer surface is further heat-treated under the reductive gas, the amount of Ag of the spacer surfaces is increased and the amount of oxygen vacancy is increased, so that the conductivity of its surface is enhanced.

When the reductive gas such as hydrogen, ammonia, $H_2S$, and a mixture thereof is used, with a mixed inert gas such as nitrogen and argon, the content of the reductive gas preferably ranges from 0.1 percent by weight (wt %) to 20 wt % based on the total content of the reductive and inert gases. When the content of reductive gas is less than 0.1 wt %, it is difficult to decrease the oxygen vacancy on the glass surface, and the glass may not have enhanced conductivity. When the content of reductive gas is greater than 20 wt %, the heat-treatment efficiency may be not enhanced in proportion to the amount of gas used, and it costs much more.

The heat-treatment temperature preferably ranges from 380° C. to 580° C. When the heat-treatment temperature is less than 380° C., the reductive gas may not react and the glass may not have enhanced conductivity. When the heat-treatment temperature is greater than 580° C. , the glass may be bent.

The sheet resistance of the spacer glass before its heat-treatment is greater than $10^{15}$ Ω/□, but when the heat-treatment is performed under the reductive gas atmosphere, the sheet resistance is remarkably decreased to a range from $10^7$ Ω/□ to $10^{13}$ Ω/□. Therefore, the surface conductivity of the spacer is increased in proportion to the amount of decreased sheet resistance.

After the heat-treatment of the spacer glass, the amount of Ag, $Ag_2O$, AgO, or a mixture thereof is substantially increased on the glass surface in comparison to before its heat-treatment, and the secondary electron emission coefficient is decreased to 3 or less. Therefore, the spacer has enhanced conductivity.

In addition, by the heat-treatment of the spacer glass, the glass shows various colors such as yellow, brown, or black. The color varies according to the amount of Ag, $Ag_2O$, AgO, or a mixture thereof on the spacer surface. As the color gets deeper, the conductivity of the spacer is increased and spacer charging may not occur on its surface even when anode voltage is applied at over 5 kV (kilovolts).

The spacer of the present invention may be formed in various shapes such as a cross and a stick. Its shape is varied depending on the quartz mask pattern and etching conditions. In addition, the spacer may be cut in a preferred form for use.

A present invention provides a flat panel display including the spacer prepared from the aforementioned method. The flat panel display of the present invention is preferably a field emission display (FED).

Hereinafter, the following Examples and Comparative Example further illustrate the present invention in detail but are not to be construed to limit the scope thereof.

EXAMPLES AND COMPARATIVE EXAMPLES

Examples 1 to 4

Figure 4A:
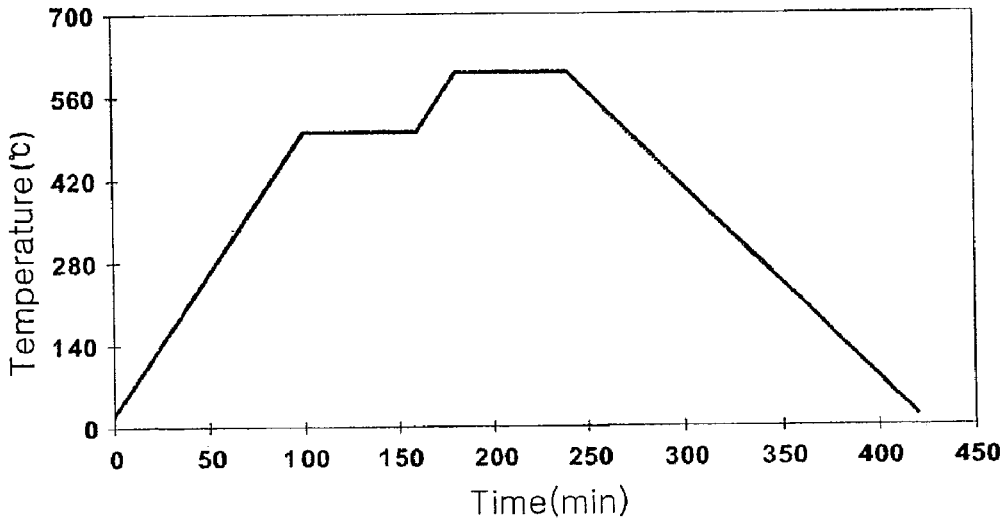
FIG. 4A shows the first heat-treatment conditions of heat-treatment steps according to Examples 1 and 4.
Figure 4B:
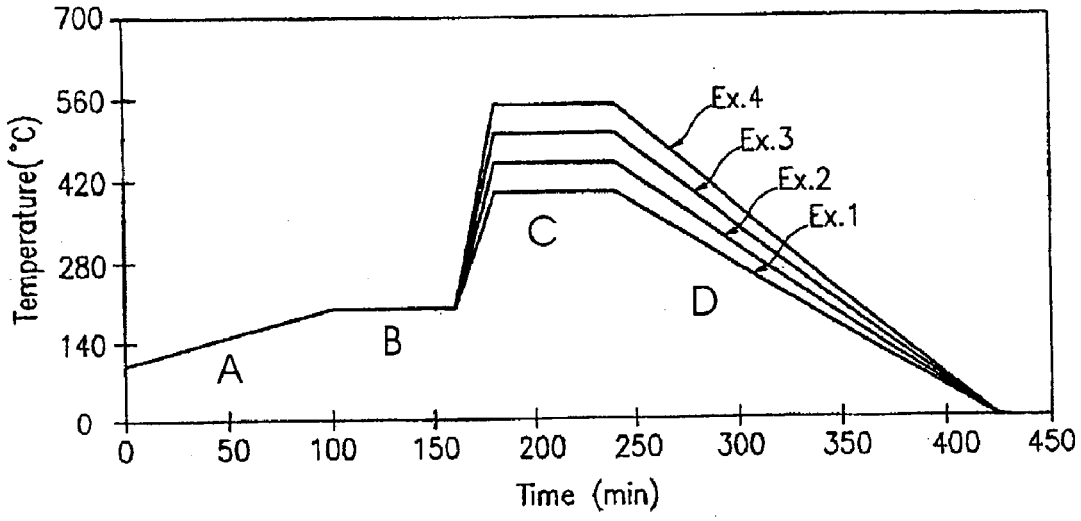
FIG. 4B shows the second heat-treatment conditions of heat-treatment steps according to Examples 1 to 4.
Figure 5A:
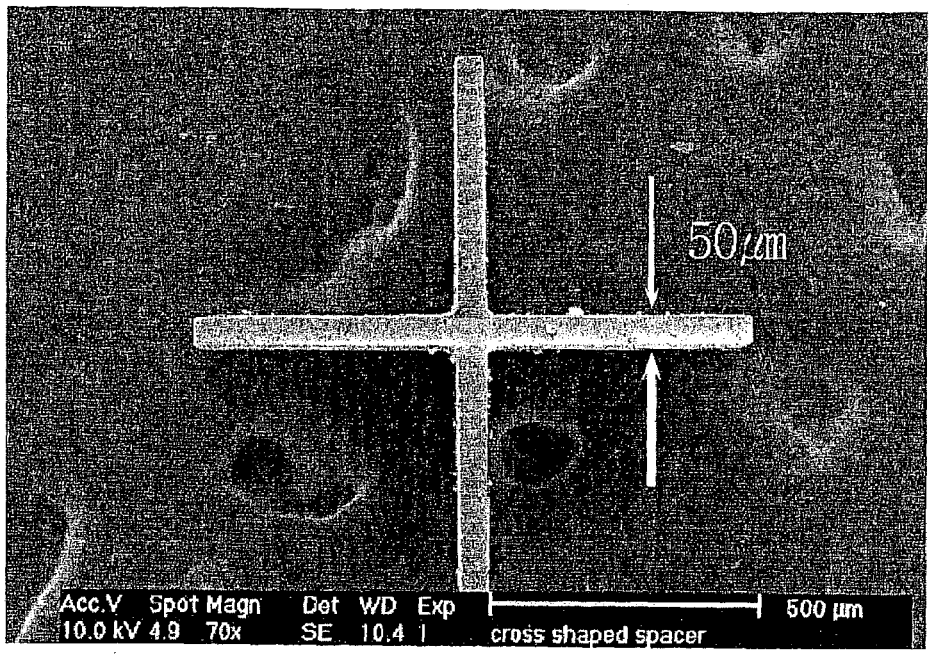
FIGS. 5A and 5B are scanning electron microscope (SEM) photographs showing a spacer according to Example 1.
Figure 5B:
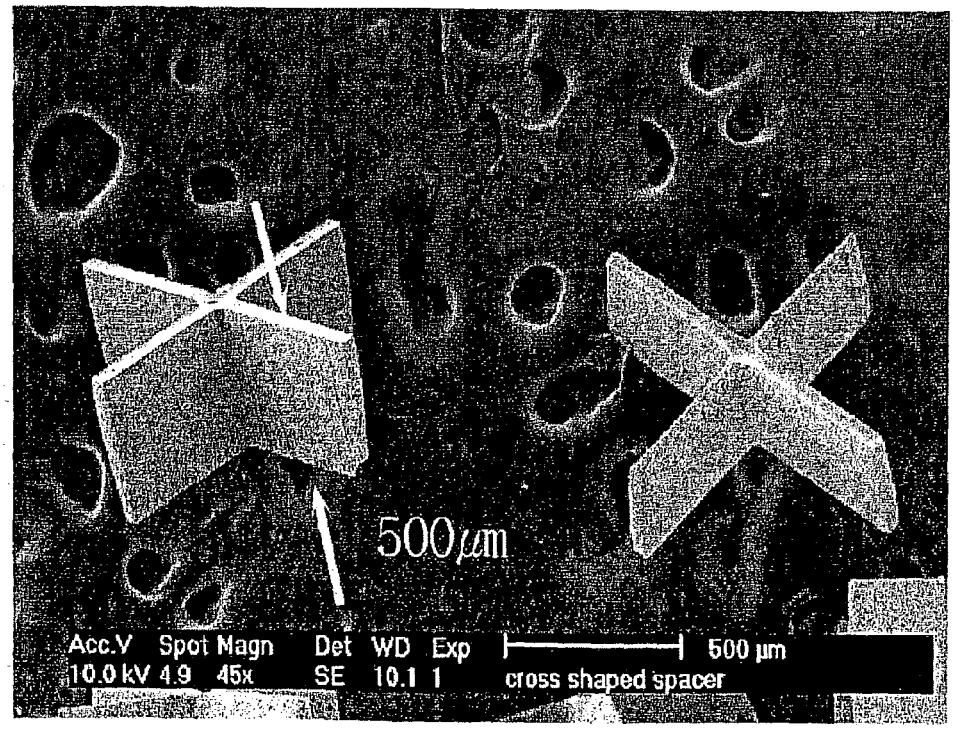
Figure 6A:
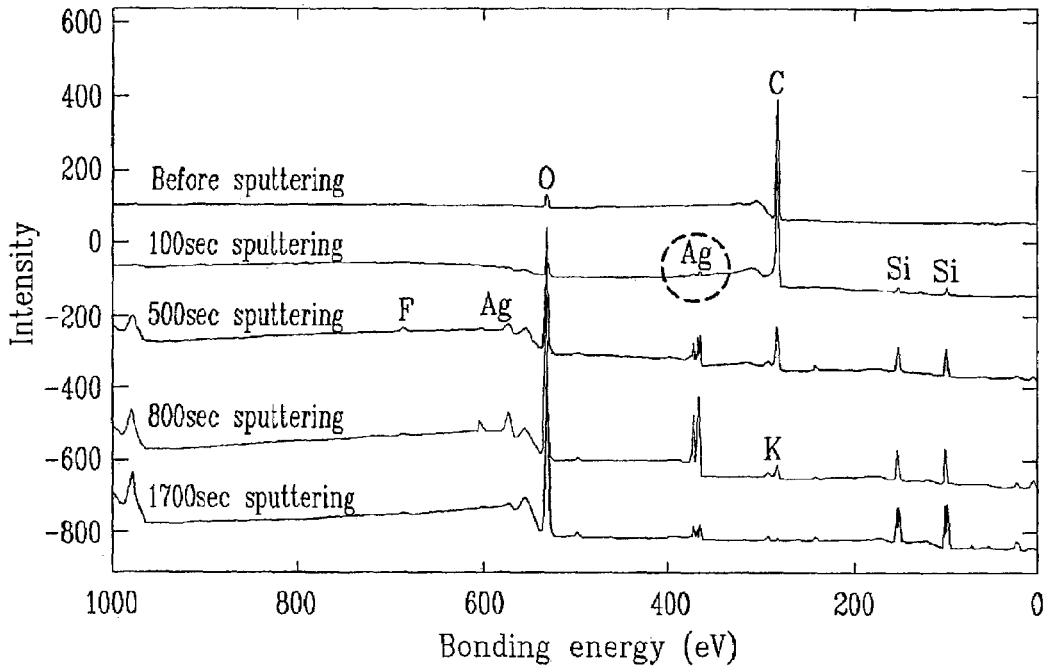
FIGS. 6A to 6D are X-ray photoelectron spectrometer (XPS) photographs showing a surface glass of a spacer according to Examples 2 to 4, and Comparative Example 1, respectively.
Figure 6B:
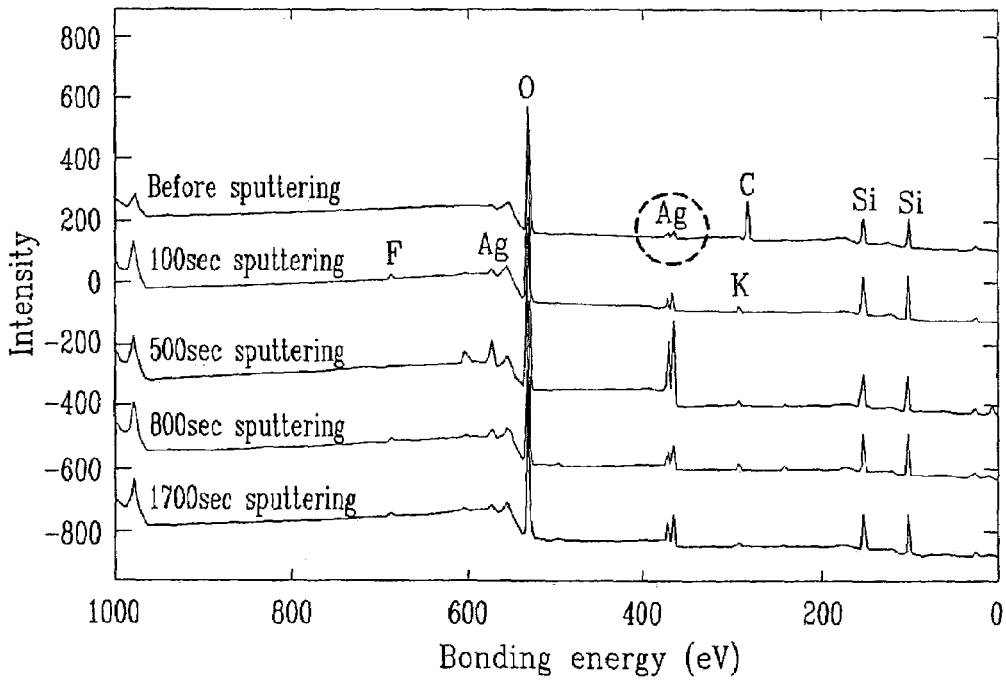
Figure 6C:
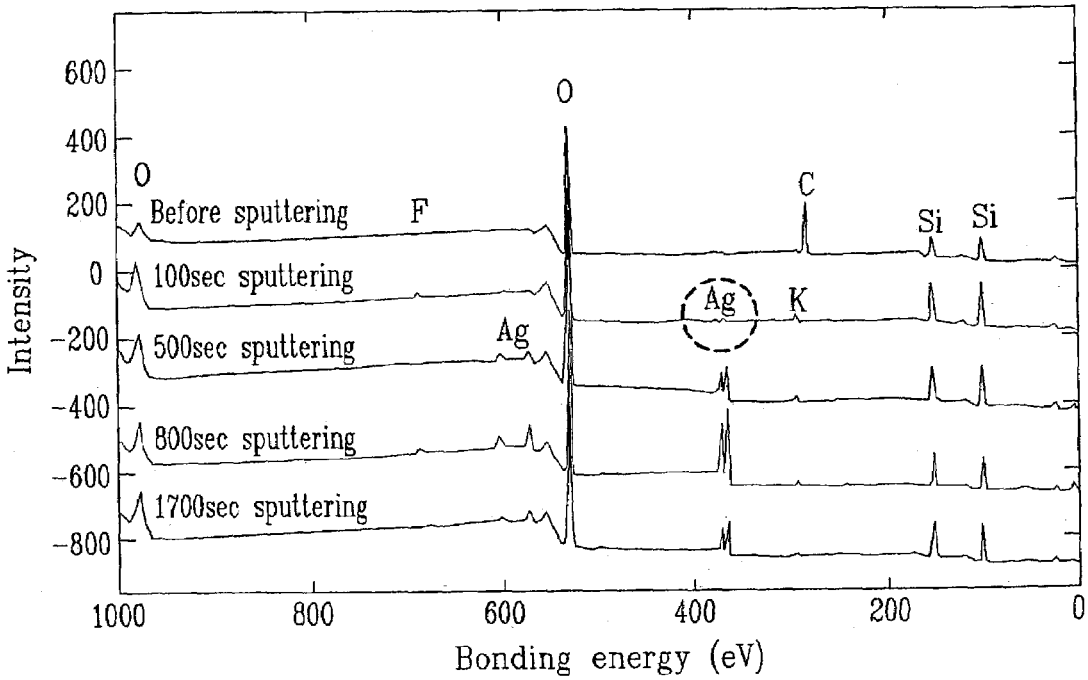
Figure 6D:
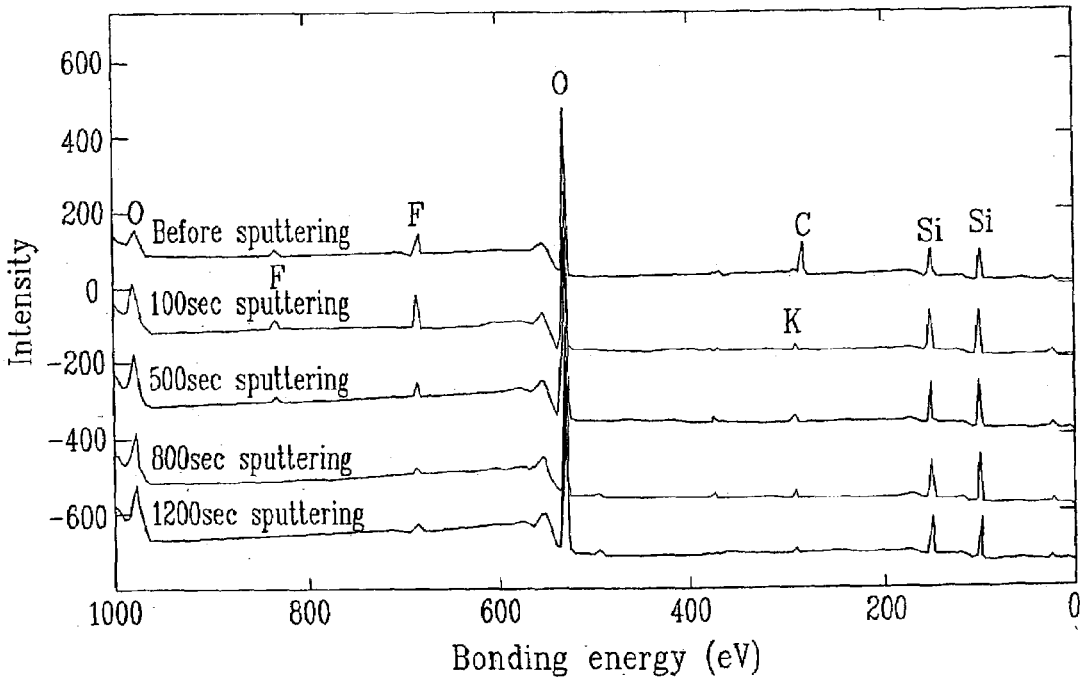

A Forturan® glass was exposed to a mercury lamp with a wave-length of 310 nm, and, firstly it was heat-treated according to the condition represented in FIG. 4A. The heat-treated glass was etched in a 10 wt % HF solution to prepare a spacer, and secondly, the spacer was heat-treated under a mixed gas atmosphere of hydrogen and argon gases including 10 wt % hydrogen gas according to the condition represented in Table 2 and FIG. 4B. The colors of each spacer of Examples are represented in Table 2. In addition, SEM photographs of each spacer according to Examples are shown in FIGS. 5*a* and 5*b*. The line width of each spacer was 50 μm and the heights were greater than 500 μm.

TABLE 2

| | A | B | C | D | Color of a spacer surface |
|---|---|---|---|---|---|
| Example 1 | 1° C./min | 200° C., 60 min | 400° C., 60 min | 1° C./min | Light yellow |
| Example 2 | 1° C./min | 200° C., 60 min | 450° C., 60 min | 1° C./min | Dark yellow |
| Example 3 | 1° C./min | 200° C., 60 min | 500° C., 60 min | 1° C./min | Dark brown |
| Example 4 | 1° C./min | 200° C., 60 min | 550° C., 60 min | 1° C./min | Black |

Comparative Example 1

A spacer was prepared by the same method as in Example 1, except that the spacer was not heat-treated after its preparation.

FIGS. 6*a* to 6*d* show results of a spacer according to Examples 2 to 4 and Comparative Example 1 respectively, which are analyzed with an X-ray photoelectron spectrometer (XPS).

As in FIGS. 6*a* to 6*d*, it is shown that Ag as well as glass components such as Si, K, and O was detected on the surfaces of the heat-treated spacers (i.e., Examples 2 to 4) that were heat-treated under a hydrogen gas atmosphere, while only the elements Si, K, and O were detected on the the surface of the spacer of Comparative Example 1. Ag was not detected on the spacer surface of Comparative Example 1 since the amount of Ag was present at less than 0.1 atom percent (at %), the detection limit of an XPS.

Therefore, it is shown that when a photosensitive glass is heat-treated under a hydrogen gas atmosphere, the Ag is sufficiently distributed on the surface of spacer to improve the conductivity thereof.

Figure 7:
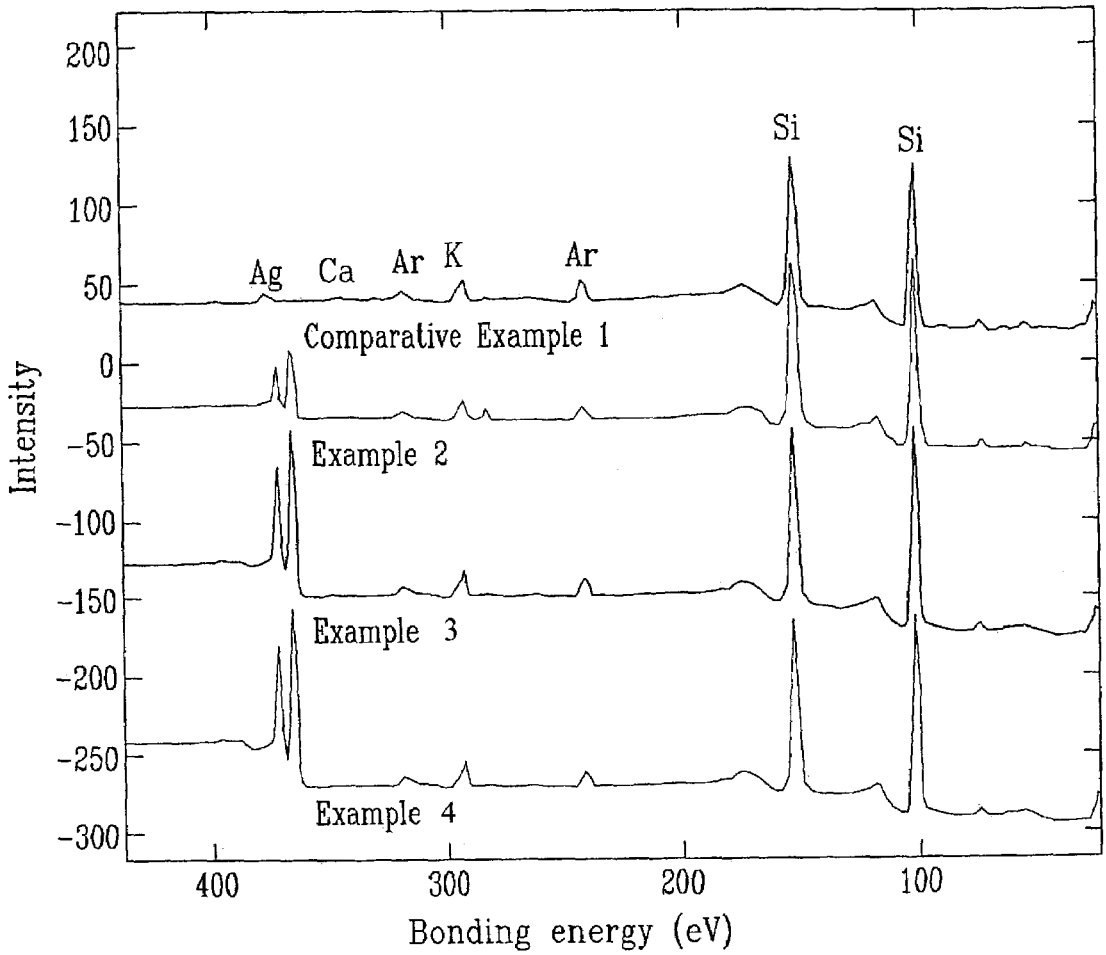
FIG. 7 is a graph showing an Ag-retained strength after sputtering the spacers for 1700 seconds according to Examples 2 to 4, and Comparative Example 1.

FIG. 7 shows a graph of an Ag-strength 1700 seconds after sputtering the spacers according to Examples 2 to 4 and Comparative Example 1.

As shown in FIG. 7, the amount of Ag of the spacer according to Comparative Example 1 that is not heat-treated under a hydrogen gas atmosphere is very small. However, the amount of Ag of the spacers according to Examples 2 to 4 that are heat-treated under a hydrogen gas atmosphere was large. Also, it is shown that as the heat-treatment temperature increases, the detected Ag peak appears higher.

Figure 8:
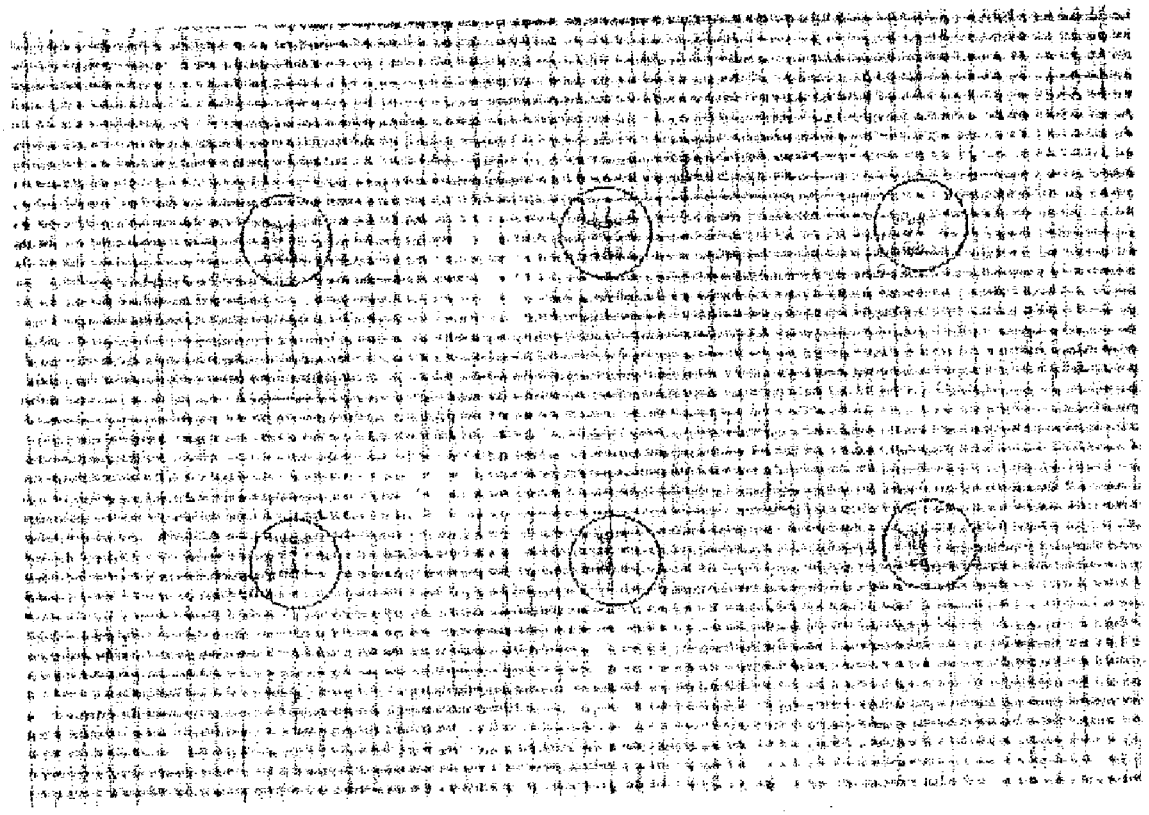
FIG. 8 is a photograph showing a flat panel display (FPD) comprising the spacer according to Example 3.
Figure 9:
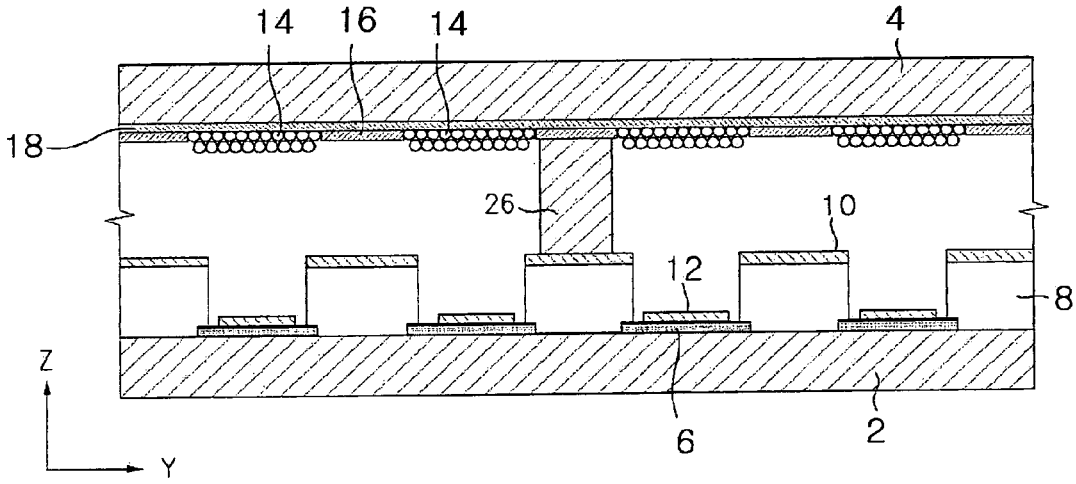
FIG. 9 is a cross-sectional view of a flat panel display constructed according to the principles of the present invention by incorporating a spacer in a field emission display.

FIG. 8 is a photograph showing a flat panel display (FPD) comprising the spacer according to Example 3. The spacer of Example 3 was applied with an anode voltage of 2.5 kV and a gate-cathode voltage of 100 volt (V) when the interval between its anode and cathode was 1 mm. The circle indicated in FIG. 8 shows a spacer and FIG. 9 illustrates a cross-sectional view of a flat panel display constructed according to the principles of the present invention by incorporating a spacer 9 in a field emission display. As shown in FIG. 9, the flat panel display provided includes first and second substrates 2 and 4 facing each other and forming a vacuum vessel; and spacer 26 arranged between the first and second substrates 2 and 4. A plurality of cathodes 6, an insulating layer 8 covering the cathodes 6, a plurality of gate electrodes 10 on the insulating layer 8, and an electron emission region 12 on the exposed cathodes 6 are formed on the first substrate 2. At least one phosphor layer 14, at least one anode 18 covering the phosphor layer 14, and black layer 16 between the phosphor layers 14 are formed on the second substrate 4. It is shown that an FPD comprising a spacer that is heat-treated under a hydrogen gas atmosphere prevents spacer charging and abnormal light emission due to spacer charging.

A flat panel display (FPD) comprising a spacer prepared by the method of the present invention has enhanced conductivity and it is easily prepared by the method. Therefore, the spacer can be prevented from having secondary electron emission, spacer charging, and electron beam deviation resulting in deterioration of display qualities and electron deflection.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A method for preparing a spacer for a flat panel display, the method comprising the steps of:

exposing a photosensitive glass comprising silver (Ag)-containing compound to a light;

causing an Ag-nucleation reaction on the photosensitive glass;

crystallizing the photosensitive glass by heat-treating the photosensitive glass;

etching the crystallized glass to prepare the spacer; and heat-treating the spacer under a reductive gas atmosphere.

2. The method according to claim 1, wherein the step of heat-treating the spacer is performed at a temperature ranging from 380 to 580° C.

3. The method according to claim 1, wherein the reductive gas is selected from the group consisting of hydrogen, ammonia, hydrogen sulfide ($H_2S$), and a mixed gas thereof.

4. The method according to claim 3, wherein the reductive gas further comprises an inert gas.

5. The method according to claim 4, wherein the content of the reductive gas ranges from 0.1 to 20 percent by weight based on a total content of the reductive gas and the inert gas.

6. The method according to claim 1, wherein the heat-treated spacer comprises Ag, $Ag_2O$, AgO, or a mixture thereof on a surface of the heat-treated spacer.

7. The method according to claim 1, wherein the prepared spacer is formed as a cross or a stick.

8. A spacer prepared by the method according to claim 1.

9. A flat panel display comprising the spacer according to claim 8.

10. A field emission display comprising the spacer according to claim 8.

11. A method of preparing a spacer for a flat panel display, the method comprising the steps of:

providing a photosensitive glass comprising $LiO_2$ and $Ag_2O$;

masking a first area of said photosensitive glass;

exposing said photosensitive glass to ultraviolet rays, wherein said ultraviolet rays are blocked in said first area;

heat-treating said photosensitive glass at about 500° C. to cause an Ag-nucleation reaction on said photosensitive glass; and heat-treating said photosensitive glass at about 600° C. to form a crystallized glass;

etching said crystallized glass to prepare the spacer; and heat-treating said spacer under an environment comprising a reductive gas.

12. The method of claim 11, wherein said ultraviolet rays have a wavelength of about 310 nanometer.

13. The method of claim 11, with said photosensitive glass comprising:

about 75 to about 85 percent by weight of $SiO_2$;

about 7 to about 11 percent by weight of $LiO_2$;

about 3 to about 6 percent by weight of $K_2O$;

about 3 to about 6 percent by weight of $Al_2O_3$;

about 1 to about 2 percent by weight of $Na_2O$;

about 0.2 to about 0.4 percent by weight of $ZnO_2$;

about 0.2 to about 0.4 percent by weight of $Sb_2O_3$;

about 0.05 to about 0.15 percent by weight of $Ag_2O$; and about 0.01 to about 0.14 percent by weight of $CeO_2$.

14. The method of claim 11, wherein the step of etching comprises using an etching solution having about 10 percent by weight of HF.

15. The method of claim 11, wherein said reductive gas is selected from the group consisting of hydrogen, ammonia, hydrogen sulfide ($H_2S$), and a mixed gas thereof.

16. The method of claim 15, wherein said environment further comprises an inert gas.

17. The method according to claim 16, wherein a content of said reductive gas is in the range between 0.1 percent by weight and 20 percent by weight based on the total content of the reductive gas and the inert gas.

18. The method of claim 16, wherein said environment comprises a hydrogen gas and an inert gas selected from the group consisting of nitrogen and argon.

19. The method of claim 11, wherein the step of heat-treating said spacer comprises heat-treating said spacer under a hydrogen gas and an inert gas selected from the group consisting of nitrogen and argon at a temperature ranging from 380° C. to 580° C. to increase an amount of Ag on a surface of the spacer.

* * * * *